United States Patent [19]

Wnukiewicz, Jr.

[11] Patent Number: 4,645,324

[45] Date of Patent: Feb. 24, 1987

[54] PHOTOGRAPHIC PRINT MAKING AND DEVELOPING TRAY ASSEMBLY

[75] Inventor: Stanley A. Wnukiewicz, Jr., Woodland Hills, Calif.

[73] Assignee: 501 Daylab, Ltd., Chatsworth, Calif.

[21] Appl. No.: 784,770

[22] Filed: Oct. 7, 1985

[51] Int. Cl.[4] ..... G03D 13/04

[52] U.S. Cl. ..... 354/312; 354/324; 354/331

[58] Field of Search ..... 354/307, 312, 313, 314, 354/315, 316, 331, 335, 337; 355/27

[56] References Cited

U.S. PATENT DOCUMENTS

| | | | |
|---|---|---|---|
| 3,465,664 | 9/1969 | Bochman | 354/312 |
| 3,903,540 | 9/1975 | Hampl | 354/312 |
| 4,085,415 | 4/1978 | Ikechi | 354/312 |
| 4,515,468 | 5/1985 | Taylor et al. | 354/337 |
| 4,518,240 | 5/1985 | Taylor et al. | 354/312 |

*Primary Examiner*—A. A. Mathews

*Attorney, Agent, or Firm*—Jack C. Munro

[57] ABSTRACT

A photographic print and developing tray which is designed to removably connect to the bottom of a base of a photographic enlarger. The photographic enlarger is to utilize a photographic transparency which is to be projected onto an unexposed photographic print paper mounted within the photographic print and developing tray. The photographic print and developing tray defines a tray housing upon which is mounted a removable cover. Associated with the tray housing is a locking arrangement to tightly secure the cover to the tray housing when in the closed position to prevent the conducting of any light within the internal chamber of the tray housing. There is also a separate latching means connected between the tray housing and the cover which becomes engaged when the cover is located in the closed position. The internal chamber is designed to receive a quantity of photographic print developing liquid. The liquid is to be supplied to the internal chamber through a separate container. This container includes a spout which is to tightly engage in a light-tight manner with a flanged sleeve arrangement mounted on the cover.

9 Claims, 10 Drawing Figures

PHOTOGRAPHIC PRINT MAKING AND DEVELOPING TRAY ASSEMBLY

BACKGROUND OF THE INVENTION

The field of this invention relates to photographic equipment and more particularly to a tray which is designed to be used in conjunction with a photographic enlarger for producing either black and white or color photographic prints.

The structure of this invention constitutes an improvement of a photographic print making and developing tray assembly defined within U.S. Pat. No. 4,518,240, issued May 21, 1985.

The structure of the aforegoing patent, as well as the structure of this invention, is to be usable by an individual to reproduce photographic prints from photographic slides within the users own environment eliminating the need for the user to take a slide to an outside source to affect the reproduction. The user is now able to obtain this reproduction without requiring a darkroom which previously has been a necessary facility for any individual engaged in photography as a hobby. The darkroom is probably the greatest obstacle preventing people from enjoying photography as a hobby. Many dwellings, particularly apartments, simply are not large enough to allow an entire room to be continually used as a darkroom. Part time use of a bathroom or closet necessitates bothersome and time consuming packing and unpacking of photographic equipment before and after each use.

No longer does the individual have to utilize outside reproduction facilities or a darkroom. The user is now able to utilize a compact portable, photographic print maker within the user's own environment (such as home or apartment). This photographic print maker is easy to operate by a person of minimal skill, requires little training, can be purchased at relatively minimal cost and produces a print within a short period of time. Such a photographic print maker is designed within the U.S. Pat. No. 4,515,468, issued May 7, 1985.

The print developing tray of this aforementioned U.S. Pat. No. 4,518,240 is to be utilized in conjunction with the photographic print maker of the aforementioned U.S. Pat. No. 4,515,468. This print developing tray includes a movable cover which is to be moved from a closed position to an open position. With the cover in the open position there is provided access into an internal chamber within the tray. With the cover in the closed position, the internal chamber is light-tight and liquid-tight. With the tray connected to the photographic print maker of the aforegoing U.S. Pat. No. 4,515,468, the cover is to be moved to expose a photographic transparency onto an unexposed photographic print which has been previously loaded within the tray. The tray is then removed from the photographic print maker and the print subsequently developed. The print is to be developed without being removed from the tray. The developing liquid is to be added within the internal chamber and moved in contact with the now exposed print. After the print is developed, the liquid is removed from the tray and the now developed print is removed from the tray by moving of the cover from the closed position to the open position.

SUMMARY OF THE INVENTION

The photographic print making and developing tray of the present invention utilizes a tray housing within which there is formed an internal chamber. This internal chamber can be made light-tight and liquid-tight by mounting of a cover on the housing. A light-tight, liquid-tight connection of the cover to the tray housing is accomplished through the use of a cover locking arrangement which comprises a series of tabs which are to be engageable with the peripheral edge of the cover to securely bind the cover to the tray housing. These tabs are connected to a side rail assembly which is mounted exteriorly of the tray housing. A manually operated cam assembly is mounted on the tray housing and in contact with the side rail assembly. Movement of the cam assembly produces the movement of the tabs in contact with the cover or movement of the tabs in a spaced position away from the cover to permit ease of disengagement of the cover from the tray housing. To indicate to the user that the cover is completely located in the closed position, there is incorporated a separate latching arrangement between the tray housing and the cover which is only engaged when the cover is in the closed position. When the cover is moved from the tray housing from the closed position to an open position, but yet a portion of the cover is still connected with the tray housing, there is formed on the cover a leg assembly which is to connect with the supportive surface that the tray housing is located on which prevents the cover from assuming any skewed or inclined position relative to the tray housing. A separate developing liquid dispensing container which has a dispensing spout, is to tightly engage with a liquid receiving opening formed within the cover. This liquid receiving opening includes an inwardly formed flange to connect with the spout to insure the obtaining of a light-tight and liquid-tight connection between this container and the cover.

The primary objective of the structure of the present invention is to construct an improved version of the photographic print making and deveoping tray defined within the aforementioned U.S. Pat. No. 4,518,240.

DETAILED DESCRIPTION OF THE SHOWN EMBODIMENT

Figure 1:
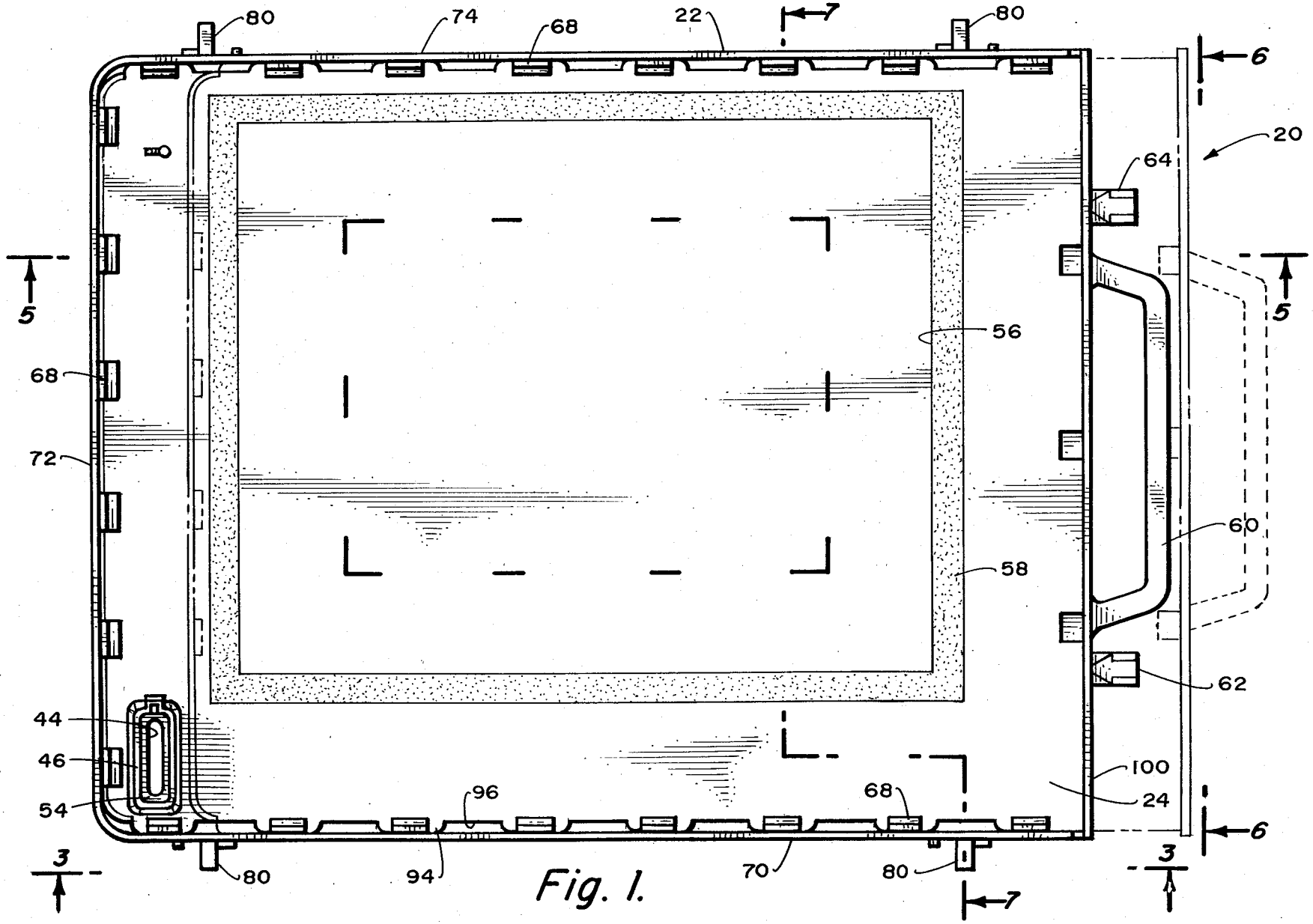
FIG. 1 is a top, plan view of the print making and developing tray of the present invention showing the removable cover in the closed position, but depicting movement to an open position in dotted lines.

Referring particularly to the drawings there is shown the photographic print making and developing tray 20 of this invention which is generally composed of a tray housing 22 and a cover 24. The tray housing 22 has an internal chamber 26. The internal chamber 26 connects with an elongated channel 28. A ridge 30 separates the channel 28 from the internal chamber 26.

Surrounding the internal chamber 26 is the peripheral edge of the tray housing 22 which is formed into a flange 32. Mounted within the flange 32 is a resilient, such as rubber or plastic, sealing member 34. The function of the sealing member 34 is to provide for an extremely light-tight and liquid-tight connection with the cover 24 when the cover 24 is located in the closed position.

Internal chamber 26 is substantially planer with upstanding side walls extending thereabout. Connectable with the internal chamber 26 is an insert 36. The insert 36 includes a substantially planer upper surface which includes a series of bumps 38. the unexposed photographic print 40 (usually formed of paper sheet material) is to be located on the bumps 36. The bumps 36 function to support the print 40 slightly spaced off the surface of the insert 36 so that developing fluid (not shown) has a chance to come into contact with both the upper and lower sides of the print 40.

The print 40 is supported between spaced-apart, slightly bendable, upstanding protuberances 42. Each of the protuberances 42 have outwardly extending protrusions which the print 40 must pass in order to rest on the bumps 36. These protrusions function to assist in holding in correct position the print 40 to keep it flush against the bumps 36. For more detailed explanation of the insert 36, reference is to be had to the aforementioned U.S. Pat. No. 4,518,240.

Cover 24 includes an opening 44. Surrounding the opening 44 is a sleeve 46. The sleeve 46 extends some distance above the upper exterior surface of the cover 24. With the cover 24 in position on the tray housing 22, the opening 44 connects with elongated channel 28. Fixedly mounted on the undersurface of the tray 24 and located within the channel 28 is a light baffle 48. The function of the light baffle is to prevent stray light that may have passed through opening 44 from reaching print 40. Container 50 has a spout 52 which fits in a close conforming manner within sleeve 46. The interior wall of the sleeve 46 has an inwardly extending flange 54 which is to abut against the outer end of the spout 52 to insure tha a liquid-tight as well as a light-tight connection between the container 50 and the cover 24 is established. For more detailed explanation of the container 50 and its operation in conjunction with the tray assembly 20, reference is to be had to the aforementioned patents.

In order to facilitate composing of the picture that will be produced from the print 40, there is formed on the exterior surface of the cover 24 a focusing target 56. Focusing target 56 includes an enlarged center area with the shaded peripheral edge 58. The shaded peripheral edge 58 is to facilitate orienting of the image in the desired position so that it will be oriented in a similar desired manner with respect to the print 40. For more detailed explanation of the focusing target 56, again reference is to be had to the aforementioned patents.

Figure 2:
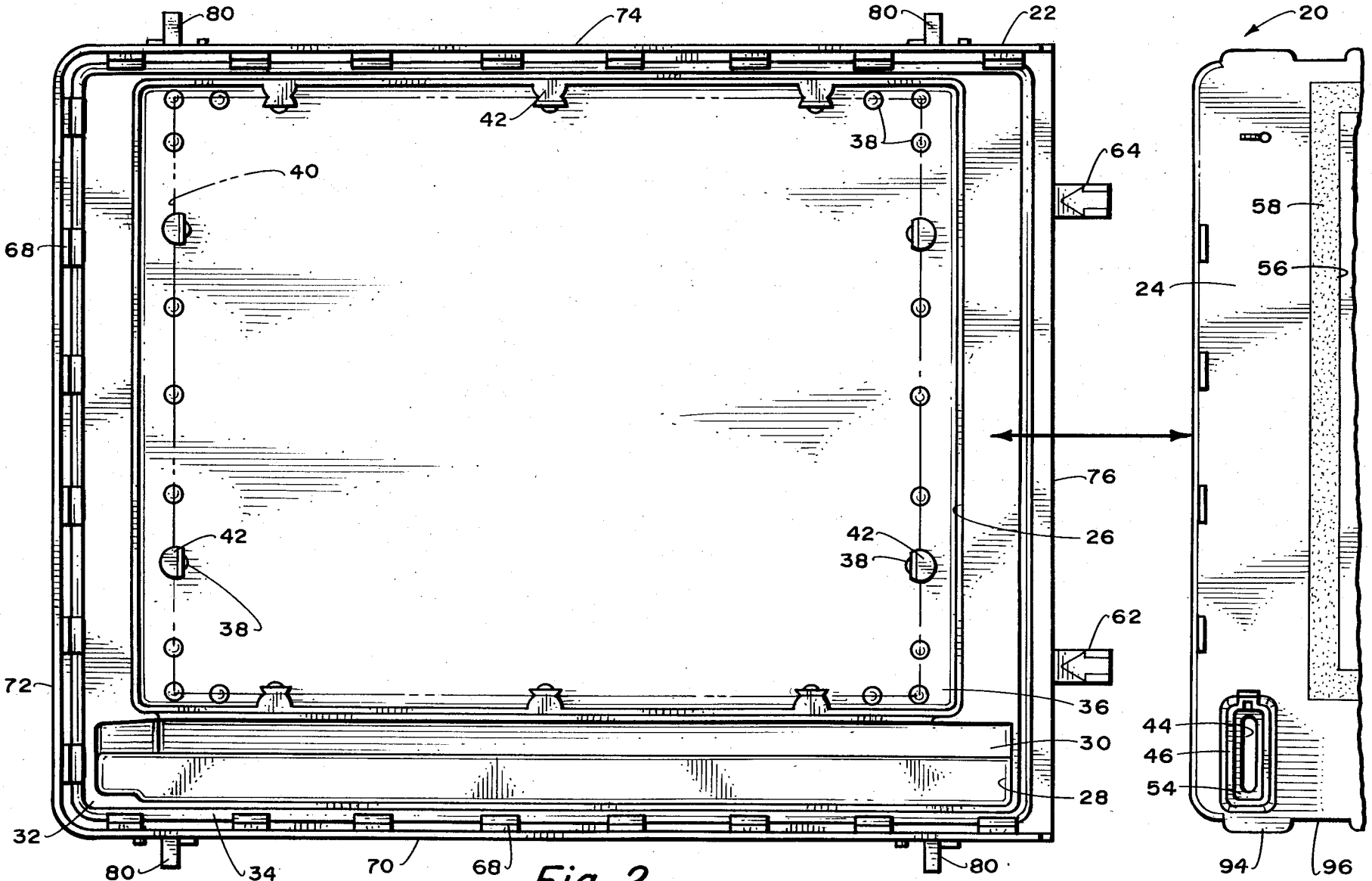
FIG. 2 is a top, plan view of the print making and developing tray of the present invention similar to FIG. 1, but showing the removable cover removed from the tray housing.

In order to facilitate moving of the cover 24 from a closed position shown in FIG. 1 to the open position shown in FIG. 2, there is mounted on the front end of the cover 24 a handle 60. In order to remove the cover 24, it is only necessary for the user or operator to grasp the handle 60 and place a thumb against either protuberance 62 or 64 which permits for the exertion of a slight withdrawing force to remove the cover 24 from the tray housing 22. In essence, the handle 60 and the protuberances 62 and 64 function together as a fulcrum to facilitate the applying of torque to remove the cover 24.

The tray housing 22 has an open upper edge which constitutes the access opening providing entry into the internal chamber 26. Formed within the tray housing 22 directly adjacent the upper edge are a series of openings 66. It is to be noted that openings 66 are evenly spaced-apart and are located entirely along the left side, backside, and right side of the side walls of the tray housing 22. Only in the area of a portion of the side wall located at the front end of the tray housing 22 are there no openings 66.

Extending within each opening is a tab 68. Each tab 68 is fixedly mounted onto a side rail member, such as side rail members 70, 72 and 74. Side rail member 70 is located on the left side of the tray housing 22, with the side rail member 72 mounted directly against the backside of the tray housing 22, and the side rail member 74 located directly against the right side of the tray housing 22. The tabs 68 are slightly offset from the main body of the side rail members 70, 72 and 74 so that each of the tabs 68 are able to slip through their respective openings 66 with the main body of each side rail member abutting against the side walls of the tray housing 22. The tabs 68 are to be positioned within the interior of the area defined by the side wall of the tray housing 22 which can generally be termed the internal chamber 26.

The side rail 70 is interlockingly connected to the side rail 72 at one end thereof. In a similar manner one end of the side rail 74 interlockingly engages with the side rail 72. The free ends of the side rails 70 and 74, in a similar manner, interlockingly engage with a side rail 76 which extends across the front end of the tray housing 22. It is to be noted that the side rails 70, 72, 74 and 76 are capable of a limited movement with respect to the tray housing 22. Because the side rails 72 and 76 are interlocked with rails 70 and 74, if the rails 70 and 74 are moved by some device, the rails 72 and 76 will automatically follow in that movement.

In order to affect the movement of the side rails 70 and 74, there are mounted within holes 78 within the tray housing 22 a pair of manually turnable levers 80. A similar pair of levers 80 are also mounted within appropriate holes (not shown) formed within the right side of the tray housing 22. The levers 80 are pivotable from the position shown in FIG. 3 to the position shown in FIG. 4. Pivoting of the levers 80 is limited to within the gap area between the ends of the substantially ring-shaped protuberance 82 formed on the exterior surface of the rails 70 and 74. A portion of each of the levers 80 is confined in the space between the ends of each protuberance 82. The extent of movement of each lever 80 is approximately ninety degrees.

Inwardly extending from each lever 80 is a shaft 84 which has an enlarged end 86. This enlarged end 86 rests within the opening 78 with the shaft 84 being closely confined within a hole 88. The hole 88 is defined by a portion of the tray housing 22 and also a portion of an insert 90 which is placed within the lower section of the opening 78 and adhesively secured in place after the shaft 82 is positioned so that the enlarged end 86 is correctly positioned within the opening 78.

Figure 7:
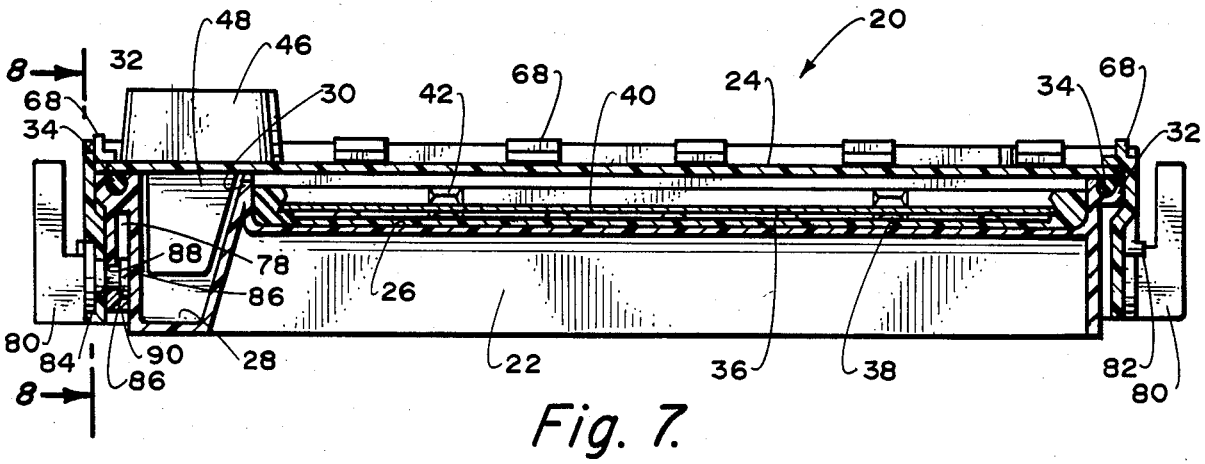
FIG. 7 is a transverse cross-sectional view through the print making and developing tray of the present invention taken along line 7—7 of FIG. 1.
Figure 8:
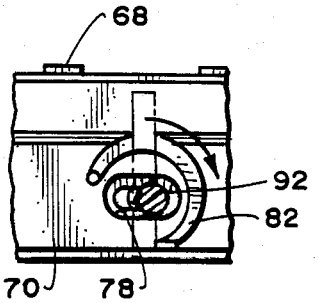
FIG. 8 is a view, partly in cross-section, through one of the manually operated levers, showing the cam associated therewith to achieve the movement of the locking arrangement and showing the cam in the unlocked position.
Figure 9:
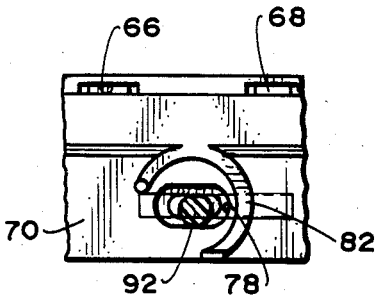
FIG. 9 is a view similar to FIG. 8, but showing the cam in the locked position.
Figure 10:
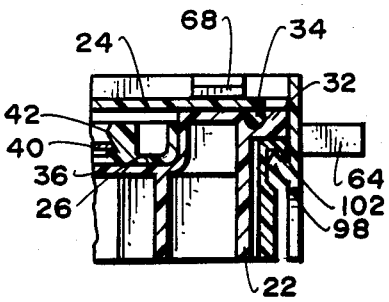
FIG. 10 is a cross-sectional view taken through the edge of the tray housing within the present invention showing the cover in a completely latched position with the tray housing.

The shaft 84 is then integrally connected to smoothly contoured offset member known as a cam 92. With the levers 80 in position shown in FIG. 7, the cam 92 is in a position which holds the tabs 68 spaced above the upper exterior surface of the cover 24 when the cover is located on the tray housing 22. This means that the cover 24 can be easily moved in and out of the tray housing 22. It is to be noted that the edge of the cover 24 includes a series of protuberances 94 which are spaced from each other by spaces 96. If such is desired, the user only need to orient the spaces 96 directly in alignment with the tabs 68 and by lifting of the cover 24 affect complete separation of the cover 24 from the tray housing 22.

Figure 3:
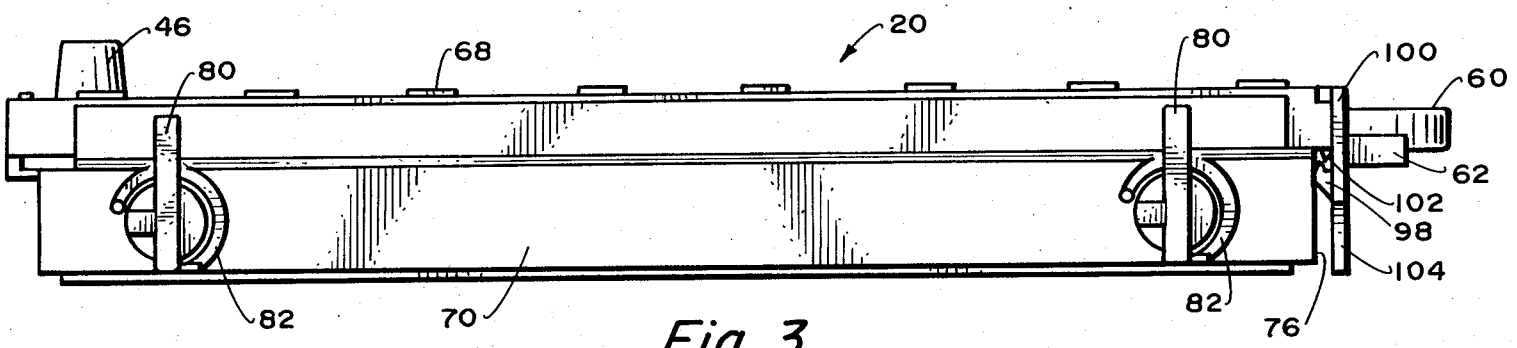
FIG. 3 is a left side, elevational view of the print making and developing tray of the present invention taken along line 3—3 of FIG. 1, showing the locking arrangement incorporated within the tray of this invention in the unlocked position.
Figure 4:
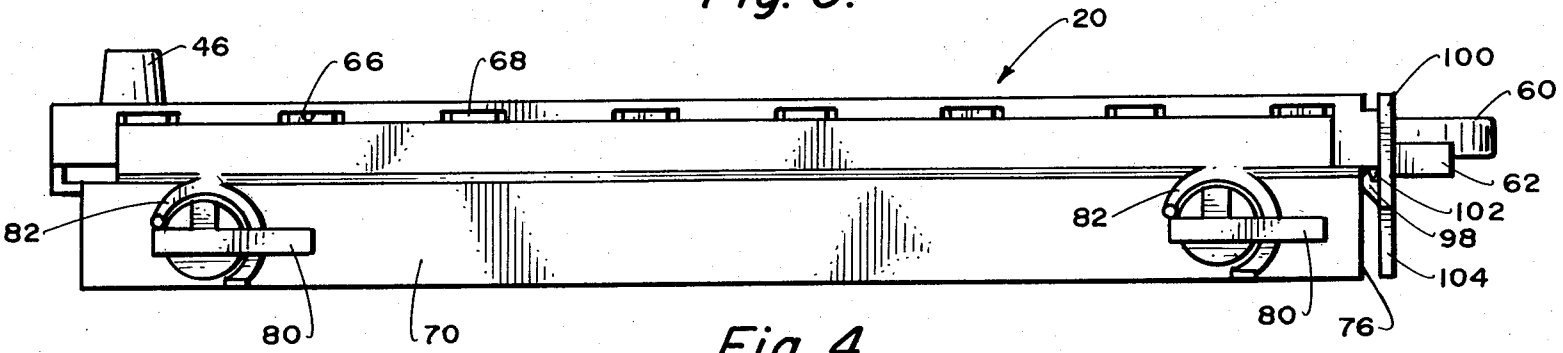
FIG. 4 is a view similar to FIG. 3, but showing the locking arrangement in the locked position.
Figure 5:
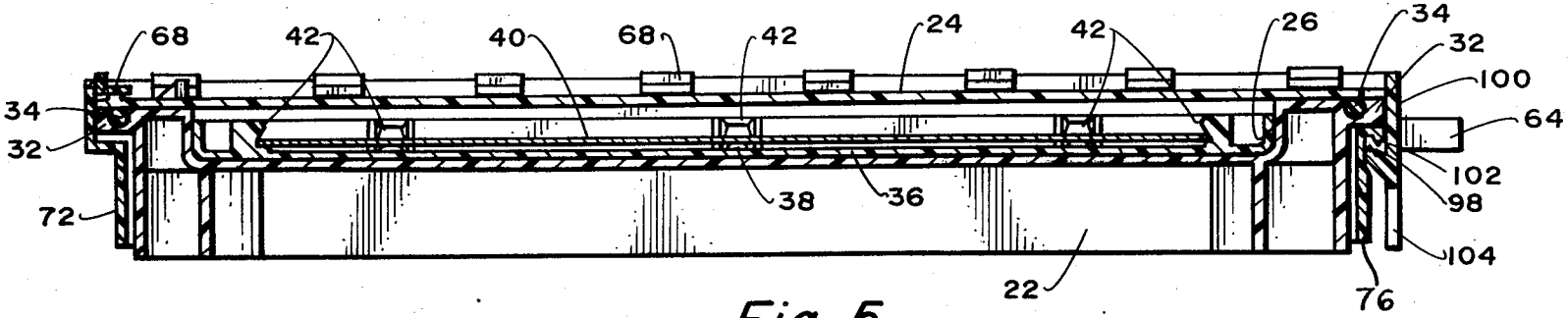
FIG. 5 is a cross-sectional view taken along line 5—5 of FIG. 1, showing more clearly the locking and latching arrangement between the cover and the tray housing.
Figure 6:
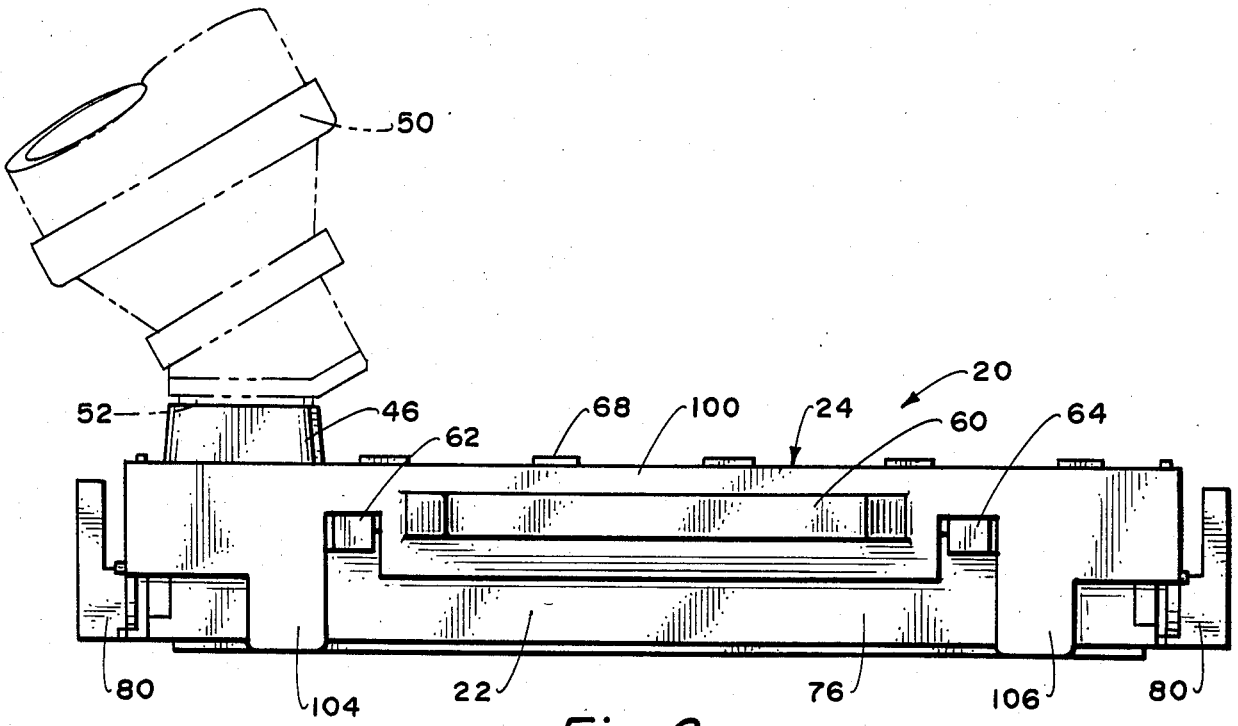
FIG. 6 is a front end, elevational view of the print making and developing tray of the present invention taken along line 6—6 of FIG. 1.

Turning of the levers 80 from the position shown in FIG. 3 to the position shown in FIG. 4 causes the cam 92 to push against the lower surface of the slot 78 which results in relative movement between the side rails 70, 72, 74 and 76 and the tray housing 22 (it is being assuemd that all four in number of the levers 80 are manually turned from the position in FIG. 3 to the position in FIG. 4). This relative movement results in the tabs 68 being moved into snug contact with the exterior surface of the cover 24. This snug contact results in the cover 24 being compressed tightly against the seal 34 and pressing such thereby securing in position the cover 24 in a liquid-tight and fluid-tight connection with the tray housing 22.

It is normally desirable to have some type of latching device to indicate when the cover 24 is fully engaged with the tray housing 22. Partial engagement would result in premature exposure of the print 40. Therefore, when the cover 24 is fully inserted to the closed position, there are a pair of pawl members 98 mounted on the interior surface of the front end 100 of the cover 24. These pawls 98 are to "snap" over a similar pair of facing pawls 102 which are mounted on the front end of the tray housing 22. This slight detent arrangement gives the indication to the user or operator that when this "snapping" action occurs, the cover 24 is fully engaged with the tray housing 22.

The front end 100 also includes a pair of downwardly depending legs 104 and 106. The length of the legs 104 and 106 is such that with the tray housing 22 mounted on a supporting surface, such as a table, and the cover 24 is partially removed from the tray housing 22, the legs 104 and 106 will also rest on the supportive surface thereby preventing cover 24 from assuming an angular or skewed position relative to tray housing 22.

What is claimed is:

1. In combination with a photographic print making and developing tray having a tray housing, said tray housing defining an open box-like configuration comprising a bottom wall which has a peripheral edge to which is attached a side wall, said side wall enclosing an internal chamber, said side wall having an upper edge, said upper edge forming an access opening for said internal chamber, a cover connectable with said tray housing, said cover movable between a closed position and an open position, said closed position completely covering said access opening in a light-tight manner, said open position permitting unrestricted access into said internal chamber, the improvement comprising:

a cover locking means for tightly securing said cover to said tray housing when said cover is in said closed position, said cover locking means being movable between a locked position and unlocked position, said locked position tightly securing said cover to said tray housing, said unlocked position permitting free movement of said cover to said open position;

said cover locking means including a side rail assembly, said side rail assembly mounted in juxtaposition to said side wall of said tray housing, said side rail assembly including a plurality of parts interlocked together, said side rail assembly totally encompassing said tray housing, said side rail assembly being movable relative to said tray housing; and said tray housing including a series of spaced-apart openings formed within said side wall, said series of spaced-apart openings being located directly adjacent said upper edge, said side rail assembly including a plurality of spaced-apart tabs, a said tab to connect with a said opening, said tabs being located within said internal chamber.

2. The combination as defined in claim 1 wherein:

cam means mounted on said tray housing, said cam means connecting with said side rail assembly, said cam means being manually movable to affect movement of said cover locking means between said locked position and said unlocked position.

3. The combination as defined in claim 2 including:

sealing means located between said tray housing and said cover, said seal means being resilient, with said cover in said locked position said seal means functioning to maintain said internal chamber light-tight and liquid-tight.

4. The combination as defined in claim 3 including:

latching means mounted on both said cover and said tray housing, said latching means being engaged when said cover is in said closed position and said cover locking means being in said locking position, whereby said latching means indicate to the user that upon engagement of said latching means said cover is totally located within said closed position.

5. The combination as defined in claim 1 wherein:

said cover having a side edge, said side edge having a plurality of spaced-apart protuberances with there being a space between each directly adjacent pair of said protuberances, with said cover locking means in said locked position a said tab is to engage with a said protuberance, with said cover located in a position other than said closed position each said tab is to be connectable with a said space to prevent separation of said cover from said tray housing.

6. The combination as defined in claim 4 including:

said cover having a handle mounted thereon to facilitate manual movement of said cover from said closed position to said open position, said cover having a downwardly extending leg assembly, with said tray housing being located on a supporting surface and said cover connecting with said tray housing said downwardly extending leg assembly also being in contact with the supporting surface.

7. In combination with a photographic print making and developing tray having a tray housing, said tray housing defining an open box-like configuration comprising a bottom wall which has a peripheral edge to which is attached a side wall, said side wall enclosing an internal chamber, said side wall having an upper edge, said upper edge forming an access opening for said internal chamber, a cover connectable with said tray housing, said cover movable between a closed position and an open position, said closed position completely covering said access opening in a light-tight manner, said open position permitting unrestricted access into said internal chamber, the improvement comprising:

a cover locking means for tightly securing said cover to said tray housing when said cover is in said closed position, said cover locking emans being movable between a locked position and unlocked position, said locked position tightly securing said cover to said tray housing, said unlocked position permitting free movement of said cover to said open position; and latching means mounted on both said cover and said tray housing, said latching means being engaged when said cover is in said closed position and said cover locking means being in said locking position, whereby said latching means indicate to the user that upon engagement of said latching means said cover is totally located within said closed position.

8. In combination with a photographic print making and developing tray having a tray housing, said tray housing defining an open box-like configuration comprising a bottom wall which has a peripheral edge to which is attached a side wall, said side wall enclosing an internal chamber, said side wall having an upper edge, said upper edge forming an access opening for said internal chamber, a cover connectable with said tray housing, said cover movable between a closed position and an open position, said closed position completely covering said access opening in a light-tight manner, said open position permitting unrestricted access into said internal chamber, the improvement comprising:

a cover locking means for tightly securing said cover to said tray housing when said cover is in said closed position, said cover locking means being movable between a locked position and unlocked position, said locked position tightly securing said cover to said tray housing, said unlocked psoition permitting free movement of said cover to said open position; and said cover having a handle mounted thereon to facilitate manual movement of said cover from said closed position to said open position, said cover having a downwardly extending leg assembly, with said tray housing being located on a supporting surface and said cover connecting with said tray housing said downwardly extending leg assembly also being in contact with the supporting surface.

9. In combination with a photographic print making and developing tray having a tray housing, said tray housing defining an open box-like configuration comprising a bottom wall which has a peripheral edge to which is attached a side wall, said side wall enclosing an internal chamber, said side wall having an upper edge, said upper edge forming an access opening for said internal chamber, a cover connectable with said tray housing, said cover movable between a closed position and an open position, said closed position completely covering said access opening in a light-tight manner, said open position permitting unrestricted access into said internal chamber, the improvement comprising:

a cover locking means for tightly securing said cover to said tray housing when said cover is in said closed position, said cover locking means being movable between a locked position and unlocked position, said locked position tightly securing said cover to said tray housing, said unlocked position permitting free movement of said cover to said open position; and an aperture formed within said cover, a sleeve mounted on said cover, said sleeve being located directly around said aperture, said aperture being adapted to pass liquid into said internal chamber with said cover in said closed position, said cover including a flange, said flange being located within said aperture inwardly with respect to the side wall of said sleeve, a liquid containing container connectable to said sleeve in a substantially light-tight manner, said flange to engage with a portion of said container to further insure the establishment of the light-tight connection between said container and said cover.

* * * * *